US009924816B2

(12) United States Patent
Oakes

(10) Patent No.: US 9,924,816 B2
(45) Date of Patent: Mar. 27, 2018

(54) SYSTEM AND METHOD FOR HOLDING CUTLERY TOGETHER

(75) Inventor: Shawn A. Oakes, Ripon, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 1312 days.

(21) Appl. No.: 13/156,073

(22) Filed: Jun. 8, 2011

(65) Prior Publication Data

US 2011/0296693 A1 Dec. 8, 2011

Related U.S. Application Data

(60) Provisional application No. 61/352,581, filed on Jun. 8, 2010.

(51) Int. Cl.
*A47G 21/06* (2006.01)
*A47F 1/10* (2006.01)

(52) U.S. Cl.
CPC ..... *A47G 21/06* (2013.01); *A47F 2001/103* (2013.01)

(58) Field of Classification Search
CPC ..... A47G 21/02; A47G 21/06; A47G 19/06; B29L 2031/286
USPC ..... 30/123, 137, 142, 143, 147, 148, 149, 30/150; 7/110–113; 206/541, 553; 156/290–292
See application file for complete search history.

(56) References Cited

U.S. PATENT DOCUMENTS

| | | | |
|---|---|---|---|
| 46,832 | A | 3/1865 | Thorpe |
| 592,105 | A | 10/1897 | Barnes |
| D32,913 | S | 7/1900 | Graf et al. |
| 703,718 | A | 7/1902 | Cammann |
| 716,058 | A | 12/1902 | Lang et al. |
| 925,485 | A | 2/1909 | Lafler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,261,835 | A | 4/1918 | Martin |
| 1,353,109 | A | 9/1920 | Carr |
| 1,355,583 | A | 10/1920 | Zeidler et al. |
| 1,482,071 | A | 1/1924 | Duff et al. |
| 1,497,585 | A | 6/1924 | Poole |
| 1,504,098 | A | 8/1924 | Cathey |
| 1,546,077 | A | 7/1925 | Hunter et al. |
| 1,547,151 | A | 7/1925 | Watling |
| 1,560,938 | A | 11/1925 | Lund |
| 1,577,302 | A | 3/1926 | Schultz |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

JP2004261336 translation; Matsushima et al, Sep. 24, 2004.*

(Continued)

*Primary Examiner* — Laura M Lee

(57) ABSTRACT

A module of cutlery may include a plurality of utensils that include a formable material, wherein at least two of the utensils are separably coupled to one another via at least one of an adhesive and a common portion of the formable material.

10 Claims, 5 Drawing Sheets

(56) References Cited

U.S. PATENT DOCUMENTS 1,610,001 A 12/1926 Foster
1,635,386 A 7/1927 Pierson
1,675,510 A 7/1928 Nolan
1,767,634 A 6/1930 Weiss
1,821,377 A 9/1931 Cusick
1,886,378 A 11/1932 Dearsley
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler, Sr.
2,141,684 A 12/1938 Diemer
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A 1/1942 Hopkins et al.
2,328,486 A 8/1943 Painter
2,340,561 A 2/1944 Renfro
2,421,782 A 6/1947 Gibbs et al.
2,427,321 A 9/1947 Casey et al.
2,431,121 A 11/1947 Hunter
2,433,736 A 12/1947 Carew
2,445,026 A 7/1948 Frank
2,472,051 A 5/1949 Testi
2,497,718 A 2/1950 Earley et al.
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,752,678 A * 7/1956 Welch ..... 30/324
2,800,013 A 7/1957 George
2,806,634 A 9/1957 Baumgartner
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,889,076 A 6/1959 Van Schie
2,907,512 A 10/1959 Leone
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
2,965,262 A 12/1960 Du Bois
3,037,257 A 6/1962 Girodet
3,052,006 A 9/1962 Jonas
3,083,879 A 4/1963 Coleman
3,095,114 A 6/1963 Tobias
3,100,842 A 8/1963 Tellefsen
3,114,475 A 12/1963 Etes
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,191,802 A 6/1965 Lasting
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,334,784 A 8/1967 Morrison
3,338,471 A 8/1967 De Good
3,371,821 A 3/1968 Abood, Jr. et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Baller
3,499,538 A 3/1970 Sherard
3,558,006 A 1/1971 Redmond et al.
3,587,922 A 6/1971 Oriti
3,593,908 A 7/1971 Desmond et al.
3,654,396 A 4/1972 Biezeveld
3,680,736 A 8/1972 Viessmann
3,710,535 A 1/1973 Walter
3,741,410 A 6/1973 Henschke et al.
3,747,803 A 7/1973 Zoepf et al.
3,786,959 A 1/1974 Greb et al.
3,851,762 A 12/1974 Liblick
3,861,563 A 1/1975 Lisbin
3,862,702 A 1/1975 Johnson
3,897,886 A 8/1975 Franklin
3,932,978 A 1/1976 Kinney
3,944,128 A 3/1976 Hogan et al.
3,972,118 A 8/1976 Richard
3,987,901 A 10/1976 Dullinger
3,998,238 A 12/1976 Nigro
4,005,801 A 2/1977 Musser et al.
4,043,203 A 8/1977 Montesi
4,048,915 A 9/1977 Martin
4,091,915 A 5/1978 Claasen
4,120,662 A 10/1978 Fosslien
4,134,519 A 1/1979 Barnett et al.
4,146,123 A 3/1979 Cottrell
4,271,999 A 6/1981 Stravitz
4,288,003 A 9/1981 Fries
4,308,974 A 1/1982 Jones
4,317,284 A * 3/1982 Prindle ..... 30/340
4,382,514 A 5/1983 Williams et al.
4,489,854 A 12/1984 Wenkman et al.
4,524,512 A * 6/1985 Formo et al. ..... 30/147
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Mickelson et al.
4,614,004 A 9/1986 Oshida
4,624,616 A 11/1986 Freese et al.
4,638,921 A 1/1987 Sigl et al.
4,662,536 A 5/1987 Powers
4,666,037 A 5/1987 Weissman et al.
4,666,060 A 5/1987 Bouldin
4,691,811 A 9/1987 Arakawa et al.
4,697,673 A 10/1987 Omata
4,707,251 A 11/1987 Jenkins
4,715,514 A 12/1987 Vidondo
4,789,064 A 12/1988 Segal
4,793,539 A 12/1988 Haenni et al.
4,835,864 A * 6/1989 Tang ..... 30/150
4,863,033 A 9/1989 Buj
4,884,718 A 12/1989 Leahy
D305,709 S 1/1990 Blignaut
4,896,792 A 1/1990 Marchand
4,915,578 A 4/1990 Becker
4,921,106 A 5/1990 Spatafora et al.
4,950,120 A 8/1990 Barnes

(56) References Cited

U.S. PATENT DOCUMENTS 4,961,684 A 10/1990 Provan et al.
4,963,072 A 10/1990 Miley et al.
RE33,447 E 11/1990 Rosman
4,973,037 A 11/1990 Holbrook
4,986,442 A 1/1991 Hinterreiter
4,989,730 A 2/1991 Lemoine et al.
4,995,154 A 2/1991 Bamber
5,012,927 A 5/1991 Borst et al.
D318,600 S 7/1991 Lillelund et al.
5,054,640 A 10/1991 Tucker et al.
5,054,649 A 10/1991 Lemaire et al.
5,064,093 A 11/1991 Davis et al.
5,080,257 A 1/1992 Carnisio
5,127,546 A 7/1992 Chen
5,131,586 A 7/1992 Capy
5,156,266 A 10/1992 Sykora et al.
5,161,268 A 11/1992 Harrow
5,176,494 A 1/1993 Nigrelli et al.
5,191,997 A 3/1993 Squitieri
5,199,756 A * 4/1993 Bartlett et al. ..... 294/16
5,211,267 A 5/1993 Clark
5,249,705 A 10/1993 Gates
5,263,596 A 11/1993 Williams
D342,648 S 12/1993 Cautereels et al.
5,269,397 A 12/1993 Kawamoto et al.
5,305,875 A 4/1994 Meyer et al.
5,325,992 A 7/1994 Koller et al.
5,327,650 A 7/1994 Rojas
D351,085 S 10/1994 Schmidt
5,353,935 A 10/1994 Yeager et al.
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,479,708 A 1/1996 Thomas
5,497,863 A 3/1996 Schmidt et al.
5,509,522 A 4/1996 Laidlaw
5,518,149 A 5/1996 Lotspeich et al.
5,542,508 A 8/1996 Van Erden et al.
5,564,594 A 10/1996 Monfredo
5,579,910 A 12/1996 Bennett
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A 12/1998 Nivin
5,853,092 A 12/1998 Goodman et al.
5,904,250 A * 5/1999 De Schutter ..... 206/553
5,921,408 A 7/1999 Groenewold et al.
5,933,918 A 8/1999 Wallays
5,950,842 A 9/1999 Bauer
5,961,021 A 10/1999 Koike et al.
D420,887 S 2/2000 Chen
6,023,908 A 2/2000 Vetsch
6,023,913 A 2/2000 Gray et al.
D422,431 S 4/2000 Goins
6,047,830 A 4/2000 Chang
6,062,424 A 5/2000 Simile-Gravina et al.
6,073,795 A 6/2000 Longstreth
6,085,916 A 7/2000 Kovacevic et al.
6,098,379 A 8/2000 Spatafora et al.
6,115,921 A 9/2000 Garneau
6,134,790 A 10/2000 Watson
6,202,891 B1 3/2001 Mark
6,226,845 B1 5/2001 Fink
6,250,495 B1 6/2001 Bando
6,250,498 B1 6/2001 Lovejoy
6,289,889 B1 9/2001 Bell et al.
6,298,960 B1 10/2001 Derr
6,378,729 B1 4/2002 Kodama
D458,070 S 6/2002 Bennett et al.
6,399,079 B1 6/2002 Mehta et al.
6,412,398 B1 7/2002 Norcross et al.
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 9/2004 Renard
6,786,359 B1 9/2004 Schroeder
6,832,694 B2 12/2004 Goeking et al.
6,832,698 B1 12/2004 Dybul
6,837,028 B1 1/2005 Miano et al.
6,840,353 B2 1/2005 Arisaka
6,840,420 B1 1/2005 Hudson
6,880,211 B2 4/2005 Jackson et al.
6,945,427 B2 9/2005 Hieb
6,972,033 B2 12/2005 McNicholas
6,976,348 B1 12/2005 Miano et al.
7,013,568 B2 3/2006 Schmidt
7,076,932 B2 7/2006 Rubin
7,090,455 B2 8/2006 Lamb
7,111,369 B2 9/2006 Ho
D533,034 S 12/2006 Wasserman
D536,222 S * 2/2007 Heiberg et al. ..... D7/645
7,204,406 B2 4/2007 Bone et al.
7,210,279 B1 5/2007 Ahmed et al.
7,249,793 B1 * 7/2007 Jabr ..... 294/16
7,258,233 B2 8/2007 Lee et al.
7,322,172 B2 1/2008 Hoffman et al.
D564,819 S 3/2008 Fosburg et al.
7,412,808 B2 8/2008 Lavi
7,434,692 B2 10/2008 Ginsberg et al.
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,716,842 B2 5/2010 Sumner-Trivisani et al.
7,731,899 B2 6/2010 Talmer et al.
7,819,234 B2 10/2010 Herzog
7,856,722 B2 12/2010 Lago-Arenas
D631,337 S 1/2011 Prevost
8,070,013 B2 12/2011 Reinsel et al.
8,083,058 B2 12/2011 Marcinkowski et al.
8,083,097 B2 12/2011 Kaufman et al.
8,152,004 B2 4/2012 Smith et al.
8,272,533 B1 9/2012 D'Amelia
8,296,957 B2 * 10/2012 Muehlemann ..... 30/142
8,297,473 B2 10/2012 Smith
8,302,269 B2 11/2012 Pitman
8,360,273 B2 1/2013 Reinsel et al.
8,480,954 B2 7/2013 Talmer et al.
8,776,379 B2 7/2014 Walters et al.
8,839,522 B2 9/2014 Walters et al.
8,844,798 B2 9/2014 Linkel
9,439,518 B2 9/2016 Oakes
9,560,920 B2 2/2017 Oakes
D783,303 S 4/2017 Roche
D788,485 S 6/2017 Greenwald et al.
2001/0007308 A1 7/2001 Glassman et al.
2001/0025856 A1 10/2001 Lefevre Du Grosriez et al.
2002/0112445 A1 8/2002 Scaduto
2003/0015399 A1 1/2003 Bennett
2003/0015824 A1 1/2003 Forbes et al.
2003/0098344 A1 5/2003 Blake et al.
2003/0146061 A1 8/2003 Tournier
2004/0045398 A1 3/2004 Hayashi
2004/0045860 A1 3/2004 Edgerly et al.
2004/0089670 A1 5/2004 Goeking et al.
2004/0237311 A1 * 12/2004 Brown et al. ..... 30/141
2005/0034310 A1 2/2005 Conforti
2005/0035136 A1 2/2005 Dathe et al.
2005/0082307 A1 4/2005 Tucker
2005/0116482 A1 * 6/2005 Harris ..... 294/1.1
2005/0155186 A1 7/2005 McGuyer et al.
2005/0155229 A1 7/2005 Lee
2005/0211722 A1 9/2005 Runnels

(56) References Cited

U.S. PATENT DOCUMENTS

| | | | | |
|---|---|---|---|---|
| 2005/0224531 | A1 | 10/2005 | Bulovic | |
| 2005/0230222 | A1 | 10/2005 | Olson et al. | |
| 2005/0252057 | A1 | 11/2005 | Lavi | |
| 2006/0000190 | A1 | 1/2006 | Behnke et al. | |
| 2006/0042986 | A1 | 3/2006 | Simkowski et al. | |
| 2006/0053638 | A1 | 3/2006 | Sumner-Trivisani et al. | |
| 2006/0218795 | A1 | 10/2006 | Santa Cruz et al. | |
| 2006/0249531 | A1 | 11/2006 | Litchfield et al. | |
| 2007/0035943 | A1 | 2/2007 | Wang | |
| 2007/0108141 | A1 | 5/2007 | Smith et al. | |
| 2007/0131705 | A1 | 6/2007 | Behravesh et al. | |
| 2007/0193968 | A1* | 8/2007 | Smith et al. | 211/70.7 |
| 2007/0214650 | A1 | 9/2007 | Tomazini | |
| 2007/0250391 | A1 | 10/2007 | Prade et al. | |
| 2008/0118609 | A1 | 5/2008 | Harlfinger et al. | |
| 2008/0121650 | A1 | 5/2008 | Smith | |
| 2008/0128445 | A1 | 6/2008 | Huang et al. | |
| 2009/0194557 | A1 | 8/2009 | Van Deursen | |
| 2009/0200315 | A1 | 8/2009 | Blondeel | |
| 2010/0084418 | A1 | 4/2010 | Reinsel et al. | |
| 2010/0147869 | A1 | 6/2010 | Iliffe et al. | |
| 2010/0170915 | A1 | 7/2010 | Reinsel et al. | |
| 2011/0180562 | A1 | 7/2011 | Reinsel et al. | |
| 2011/0226797 | A1 | 9/2011 | Reinsel et al. | |
| 2012/0036724 | A1* | 2/2012 | Walters | 30/340 |
| 2012/0047744 | A1 | 3/2012 | Walters | |
| 2012/0080444 | A1 | 4/2012 | Smith et al. | |
| 2012/0110746 | A1 | 5/2012 | Allard Serrano et al. | |
| 2012/0145734 | A1 | 6/2012 | Walters | |
| 2012/0145735 | A1 | 6/2012 | Erickson et al. | |
| 2012/0145736 | A1 | 6/2012 | Walters et al. | |
| 2013/0032609 | A1 | 2/2013 | Righetti et al. | |
| 2013/0043272 | A1 | 2/2013 | Oakes | |
| 2013/0126548 | A1 | 5/2013 | Pourian et al. | |
| 2013/0134211 | A1 | 5/2013 | Linkel | |
| 2013/0152406 | A1 | 6/2013 | McFarland | |
| 2013/0193157 | A1 | 8/2013 | Jongen et al. | |
| 2014/0069930 | A1 | 3/2014 | Oakes | |
| 2014/0117036 | A1 | 5/2014 | Smith et al. | |
| 2014/0191024 | A1 | 7/2014 | Wnek et al. | |
| 2014/0299656 | A1 | 10/2014 | Wintermute | |
| 2015/0001235 | A9 | 1/2015 | Smith | |
| 2015/0028045 | A1 | 1/2015 | Oakes et al. | |
| 2015/0028046 | A1 | 1/2015 | Oakes et al. | |
| 2015/0041363 | A1 | 2/2015 | Freeman et al. | |
| 2015/0041484 | A1 | 2/2015 | Oakes | |
| 2015/0048108 | A1 | 2/2015 | Borke | |

FOREIGN PATENT DOCUMENTS

| | | | | |
|---|---|---|---|---|
| CN | 101495015 | A | 7/2009 | |
| DE | 7033238 | U1 | 11/1970 | |
| DE | 7127677 | U | 11/1971 | |
| DE | 3151268 | | 7/1983 | |
| DE | 4139938 | | 6/1993 | |
| DE | 9316566 | U1 | 1/1994 | |
| DE | 19906369 | | 2/2000 | |
| DE | 202005013647 | U1 | 7/2006 | |
| EP | 257109 | * | 3/1988 | A47G 21/06 |
| EP | 0286538 | A1 | 10/1988 | |
| EP | 0856272 | A2 | 1/1999 | |
| EP | 1022107 | A1 | 7/2000 | |
| EP | 1217923 | B1 | 9/2003 | |
| EP | 1358827 | A2 | 11/2003 | |
| EP | 1213985 | B1 | 6/2004 | |
| EP | 1514497 | A1 | 3/2005 | |
| EP | 1719438 | A1 | 11/2006 | |
| EP | 1864596 | A2 | 12/2007 | |
| FR | 2889507 | A1 | 2/2007 | |
| JP | 06-121727 | A | 5/1994 | |
| JP | JH06121727 | A | 5/1994 | |
| JP | 08011934 | A | 1/1996 | |
| JP | 08047440 | A | 2/1996 | |
| JP | 3042582 | U | 10/1997 | |
| JP | 09-294662 | * | 11/1997 | A47G 21/10 |
| JP | 2000-202851 | A | 7/2000 | |
| JP | 2001354214 | A | 12/2001 | |
| JP | 2004-261337 | A | 9/2004 | |
| JP | 2007319493 | A | 12/2007 | |
| KR | 2019910008085 | | 10/1991 | |
| KR | 1020090071515 | A | 7/2009 | |
| KR | 100954569 | B1 | 4/2010 | |
| TW | M287639 | U | 2/2006 | |
| TW | M293720 | U | 7/2006 | |
| WO | 01/05280 | A1 | 1/2001 | |
| WO | 01/05281 | A1 | 1/2001 | |
| WO | 01/68492 | A1 | 9/2001 | |
| WO | 2004/028309 | A1 | 4/2004 | |
| WO | 2007/049982 | A1 | 5/2007 | |
| WO | 2007/012606 | A1 | 11/2007 | |
| WO | 2008/058187 | A2 | 5/2008 | |
| WO | 2009137367 | A2 | 11/2009 | |

OTHER PUBLICATIONS

JP09-294662 english translation Nov. 1997,Kamishina, Masashi A47G021/10.*

International Search Report and the Written Opinion of the International Search Authority dated Feb. 9, 2012.

International Search Report and Written Opinion for PCT/US2011/044931 dated Feb. 28, 2012.

International Search Report and Written Opinion for PCT/US2011/044934 dated Mar. 6, 2012.

International Search Report and Written Opinion for PCT/US2011/058767 dated Feb. 29, 2012.

International Search Report and Written Opinion for PCT/US2011/064057 dated Feb. 29, 2012.

International Search Report and Written Opinion for PCT/US2011/058329 dated Feb. 29, 2012.

Peel Adhesion for Single Coated Pressure-Sensitive Tapes 180 Angle, Aug. 1989, pp. 21-22.

Tack Rolling Ball, Aug. 1989, pp. 29-30.

Holding Power of Pressure-Sensitive Tape, Aug. 1989, pp. 31-33.

European Patent Report 06009258.2, dated Jul. 24, 2006, five pages, Munich, Germany.

International Search Report and Written Opinion for PCT/US07/83752, dated Mar. 11, 2008, ten pages, European Patent Office, Munich, Germany.

Partial International Search Report for PCT/US2007/083922, dated Jul. 8, 2008, two pages.

European Search Report for EP 08 014 387.8 dated Nov. 11, 2008, two pages, European Patent Office, Munich, Germany.

International Search Report and Written Opinion for PCT/US2007/083922, dated Nov. 17, 2008, 13 pages, European Patent Office, Rijswijk, Netherlands.

International Search Report and Written Opinion for PCT/US2009/059915, dated Feb. 3, 2010, 13 pages, European Patent Office, Munich, Germany.

Office Actions for U.S. Appl. No. 11/556,808, filed Nov. 6, 2006.

Office Actions for U.S. Appl. No. 11/415,836, filed May 2, 2006.

Office Actions for U.S. Appl. No. 11/936,401, filed Nov. 7, 2007.

Office Action for U.S. Appl. No. 12/349,203, filed Jan. 6, 2009.

Supplementary European Search Report dated Sep. 25, 2013 for Application No. 11793088.3.

International Searching Authority, "International Search Report and Written Opinion for PCT/US2014/047463", dated Nov. 26, 2014, 22 pages, Korean Intellectual Property Office, South Korea.

International Searching Authority, "International Search Report and Written Opinion for PCT/US2014/050166", dated Nov. 20, 2014, 11 pages, Korean Intellectual Property Office, South Korea.

International Searching Authority, "International Search Report and Written Opinion for PCT/US2014/050169", dated Jan. 9, 2015, 11 pages, Korean Intellectual Property Office, South Korea.

International Searching Authority, "International Search Report and Written Opinion for PCT/US2014/051632", dated Dec. 3, 2014, 9 pages, Korean Intellectual Property Office, South Korea.

International Searching Authority, "International Search Report and Written Opinion for PCT/US2014/051639", dated Dec. 9, 2014, 9 pages, Korean Intellectual Property Office, South Korea.

(56) References Cited

OTHER PUBLICATIONS

International Search Report and Written Opinion for PCT/US2010/000051, dated Aug. 16, 2010, 6 pages.

* cited by examiner

SYSTEM AND METHOD FOR HOLDING CUTLERY TOGETHER

CROSS-REFERENCE TO RELATED APPLICATION

This application claims priority to U.S. Provisional Patent Application No. 61/352,581 filed Jun. 8, 2010, the disclosure of which is incorporated herein in its entirety by this reference.

FIELD OF THE DISCLOSURE

The present disclosure relates to a system and method for holding disposable cutlery together. In particular, the present disclosure relates to a module of disposable cutlery and methods for forming and dispensing disposable cutlery from the module.

BACKGROUND

It may be desirable to provide disposable cutlery, such as multiple utensils, for example, spoons, forks, knives, and sporks, in a configuration where the utensils are secured in groups of more than one utensil. Such a configuration may serve to save space in the packaging and storing of multiple utensils. Additionally, such a configuration may enhance the efficiency of loading a utensil dispenser. In particular, when providing utensils to patrons via a utensil dispenser, the provider may need to load the single utensils one-at-a-time into the utensil dispenser, a process that may be tedious and inefficient. Further, loading the utensils in such a manner may not result in reliable one-at-a-time dispensing, for example, if the utensils are not loaded properly.

It may also be desirable to provide secured utensils that do not produce excess waste when used in conjunction with a dispenser. For example, multiple utensils may be secured to each other via a band, wrapper, or other securing device, or they may be provided in a cartridge containing a plurality of like utensils. However, after the band, wrapper, or other securing device is removed from the utensils, such securing device or cartridge will usually be discarded as waste.

It may be desirable to provide utensils that are not prone to flipping or otherwise changing from a desired orientation during either a process of being loaded into a dispenser or a process of being dispensed from a dispenser. For example, during dispensing of a stack of utensils, utensils may have a tendency to flip or rotate as the stack slides within the dispenser, which may lead to jamming the dispenser. This may result in compromising the utility of the dispenser. Additionally, it may be desirable to provide utensils that are capable of being successfully dispensed from a dispenser one-at-a-time.

It may also be desirable to provide a group of secured utensils that can be divided into smaller groups of secured utensils. In particular, some types of banded utensils or cartridges of utensils may not be able to be loaded into an empty dispenser in smaller groups of secured utensils. This drawback may cause problems when, for example, only a few utensils remain in a dispenser and it is anticipated that a large number of utensils will be dispensed in the near future. In such a situation, someone responsible for restocking the dispenser must either wait for the utensils to be dispensed and risk having a delay between the time at which the dispenser is emptied and when it is reloaded with new utensils, or load a portion of a group of secured utensils and discard or store the remaining loose utensils.

Thus, it is desirable to provide a system and method for addressing one or more of the issues discussed above.

SUMMARY

In the following description, certain aspects and embodiments will become evident. It should be understood that the aspects and embodiments, in their broadest sense, could be practiced without having one or more features of these aspects and embodiments. Thus, it should be understood that these aspects and embodiments are merely exemplary.

One aspect of the disclosure relates to a module of disposable cutlery including a plurality of utensils including a formable material, wherein at least two of the utensils are separably coupled to one another via at least one of an adhesive and a common portion of the formable material. For example, the common portion of formable material may include one or more of the following: a portion of formable material formed concurrently with the utensils, via, for example, a molding process such as injection molding; a portion of formable material formed from individual utensils by, for example, softening and/or melting a portion of at least one utensil and allowing the softened and/or melted portion to cool in a configuration such that it separably couples at least two utensils via, for example, welding; or a portion of formable material formed separately and before (or after) softening and/or melting, introduced to at least two utensils such that, upon cooling, the material separably couples at least two utensils.

Another aspect of the disclosure relates to a method of securing a plurality of utensils to one another to form a module of cutlery. At least two of the utensils comprise a formable material. The method includes arranging the plurality of utensils such that the utensils are positioned adjacent to one another. The method further includes separably coupling at least two of the utensils that are positioned adjacent to one another via at least one of applying an adhesive to at least one of the two utensils, or providing a common portion of the formable material that separably couples the two utensils to one another, or both.

A further aspect of the disclosure relates to a method for dispensing a utensil from a module of cutlery. The method includes decoupling at least one utensil from the module by overcoming an adhesive bond when the utensils are coupled to one another via adhesive, or breaking a common portion when the utensils are coupled to one another via the common portion. The method further includes dispensing the at least one decoupled utensil.

Additional aspects of the disclosure will be set forth in part in the description which follows, or may be learned by practice of the disclosed exemplary embodiments.

Aside from the structural and procedural arrangements set forth above, the embodiments could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this description, illustrate several exemplary embodiments and together with the description, serve to explain principles of the embodiments. In the drawings.

DESCRIPTION OF EXEMPLARY EMBODIMENTS

Figure 1:
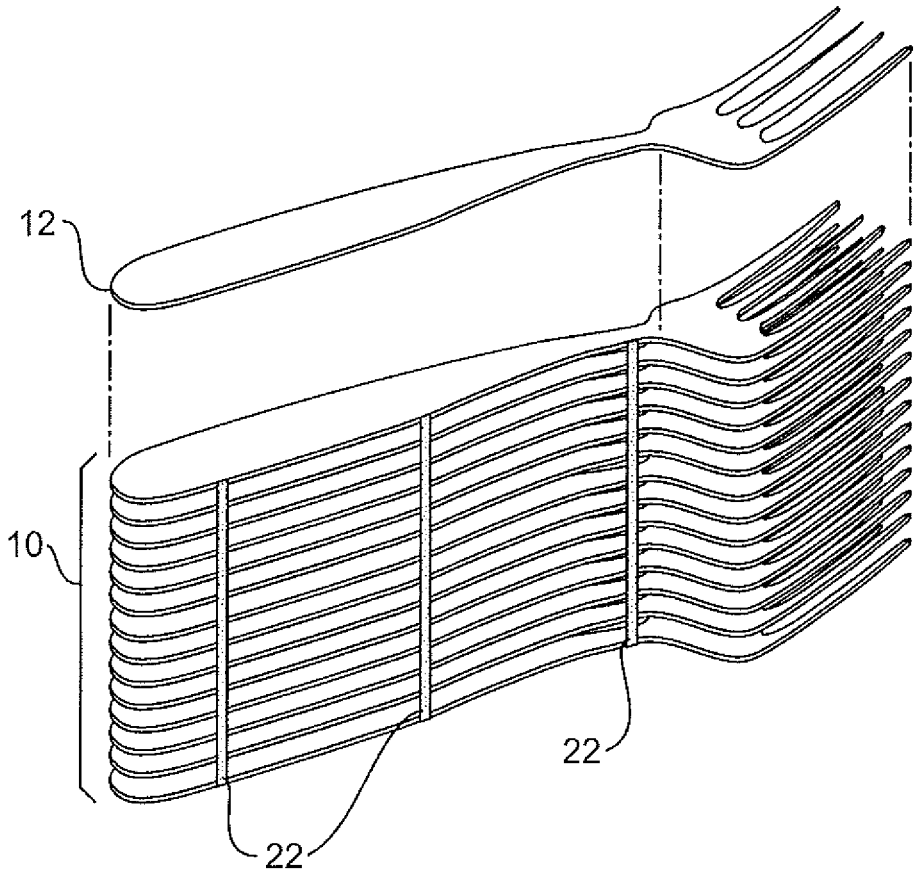
FIG. 1 is a schematic perspective view of an exemplary embodiment of a module of cutlery.

Reference will now be made in detail to exemplary embodiments. Wherever possible, the same reference numbers are used in the drawings and the description to refer to the same or like parts.

FIG. 1 shows a schematic perspective view of an exemplary embodiment of a module 10 of disposable cutlery. Module 10 comprises a plurality of utensils 12, which appear in a stacked configuration here, but which may be arranged in other configurations. Module 10 may include at least one of a spoon 14, a fork 16, a knife 18, and a spork 20 (see FIGS. 2A-2D), or any combination thereof. Module 10 may be formed with as few as two utensils 12, as many as 10, 15, 20, or 30 utensils 12, or more, as any number of utensils 12 is contemplated for module 10.

Figure 3A:
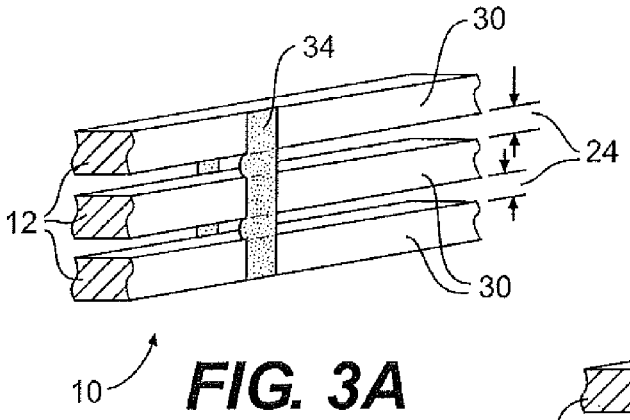
FIG. 3A is a schematic perspective view of exemplary utensils coupled to one another via exemplary continuous coupling strips.
Figure 3B:
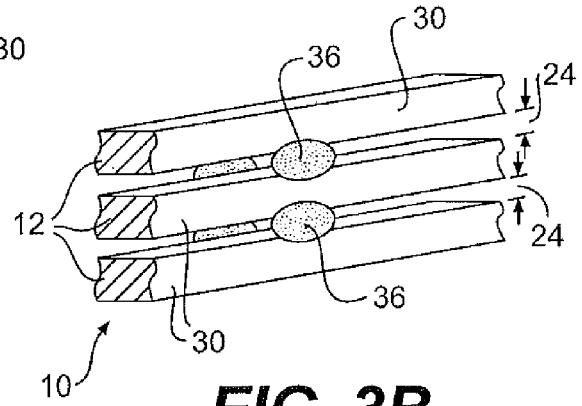
FIG. 3B is a schematic perspective view of exemplary utensils coupled to one another via exemplary intermittent couplings.
Figure 3C:
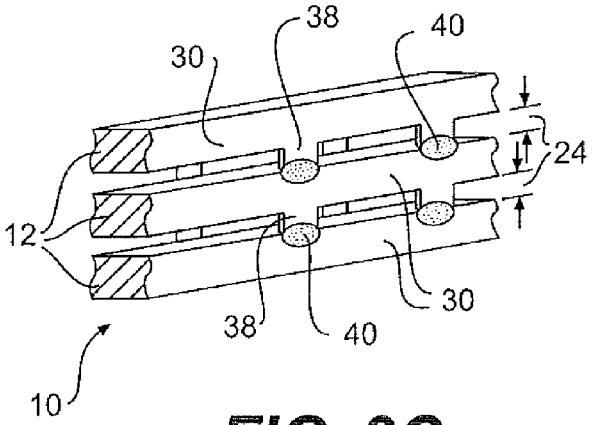
FIG. 3C is a schematic perspective view of exemplary utensils coupled to one another via exemplary protrusions.

In FIGS. 3A-3F, exemplary configurations for coupling utensils 12 to one another are shown. Exemplary couplers 22 function to couple at least two utensils 12 to one another. For example, as shown in FIG. 3A, couplers 22 may be in the form of continuous coupling strips 34. The couplers 22 may also be formed in discontinuous or intermittent coupling areas 36, for example, as shown in FIGS. 3B and 3C. Exemplary discontinuous or intermittent coupling areas 36 may couple as few as two utensils 12, as many as 10, 15, 20, 30, or 100 or more utensils 12, as any number of utensils 12 is contemplated for module 10. According to some embodiments, in addition to couplers 22, utensils 12 of a module 10 may also include, for example, a band, tie, string, or similar device around the utensils 12 of a module 10 to assist in orienting or securing module 10.

According to some embodiments, the couplers 22 may be formed via at least one of an adhesive and a common portion of a formable material, of which the utensils are made, regardless of whether the continuous strip configuration or the discontinuous or intermittent configuration—or both—are used. Additionally, in some embodiments, couplers 22 may be applied to one or both sides 30 of one or more utensils 12. If adhesive is used, it may be applied in one or more continuous coupling strips 34 that couple the utensils 12 to one another and form module 10, for example, as shown in FIG. 1. The thickness of the coupling strips 34 may vary depending, for example, on the specific type of adhesive and/or the number of strips 34 used. The coupling strips 34 may be applied perpendicular to utensils 12 or at an oblique angle. Where multiple strips 34 are used, strips 34 need not have the same orientation, and instead may overlap each other or form a shape or pattern, for example, a decorative and/or branding pattern.

The exemplary formable material described herein may include, for example, plastic, combinations of plastics, or combinations of plastics and other materials suitable for use as disposable or reusable cutlery. For example, the formable material may include one or more of polystyrene, polyethylene, and polypropylene.

Adhesive may also be applied in a discontinuous or intermittent manner. For example, adhesive deposits may be placed in one or more of the gaps 24 between the utensils 12 in a module 10, or may be placed elsewhere, for example, between the overlapping surfaces of two adjacent utensils 12 in the module 10 (see, e.g., FIGS. 3E and 3F). The adhesive deposits may align vertically, but can be applied in any orientation, including a pattern or a random disbursement. Also, adhesive deposits may be used concurrently with coupling strips 34 or additional methods of coupling utensils 12 to one another.

An example of an additional method of coupling is welding, including spot welding, ultrasonic welding, vibration welding, and any other welding technique that may be suitable for coupling two utensils 12. Another example is soldering. Yet another example is hot melting. Any form of coupling at least two utensils 12 together by forming a common portion of formable material between the utensils 12 may be used. For example, this may be accomplished by applying heat to one or more of utensils 12 to cause the formable material of at least one utensil 12 to soften or melt. Upon cooling, the softened or melted material may form a common portion of formable material that couples two or more utensils to one another. In another example, forming a common portion of formable material may be accomplished by introducing additional formable material to a module 10 of utensils 12 and softening or melting the additional formable material. Upon cooling, the additional formable material will couple at least two utensils 12 via a common portion of formable material. Similarly, forming a common portion of formable material may be accomplished by introducing additional formable material to a module 10 of utensils 12, softening or melting one or more portions of the module 10, and applying the additional formable material such that it couples a plurality of utensils 12 when the melted portion or portions harden. According to some embodiments, the common portion of formable material may be formed in an integral manner, together with utensils 12, for example, via a molding process such as form molding or injection molding, where the common portion and the utensils 12 of module 10 are formed during the same molding process.

Figure 2A:
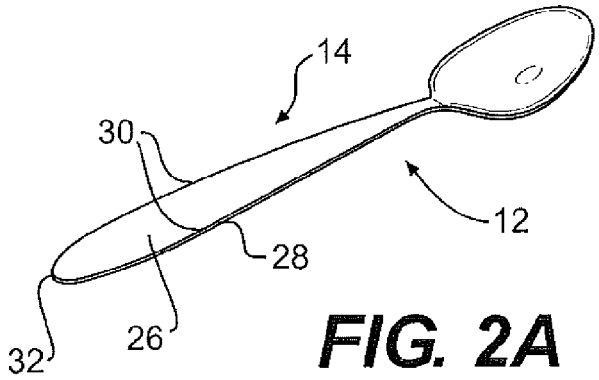
FIG. 2A is a schematic perspective view of an exemplary spoon.

Referring to FIG. 2A, it shows a schematic perspective view of an exemplary spoon 14 that may be included as a utensil 12 in module 10. Spoon 14 has a top face 26 and a bottom face 28. Spoon 14 also has two sides 30 and an end 32. Top face 26, bottom face 28, sides 30, and end 32 may each have any number of profiles, including, for example, flat, straight, shaped, curved, or tapered. In some exemplary embodiments, spoon 14 is shaped such that a plurality of spoons 14 may be stacked on top of one another. In such a stacked configuration, sides 30 of one spoon 14 may align vertically with sides 30 from an adjacent utensil 12 (e.g., another spoon 14).

Figure 2B:
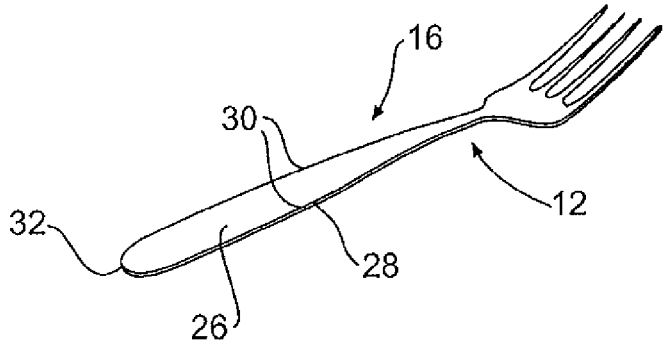
FIG. 2B is a schematic perspective view of an exemplary fork.

Referring to FIG. 2B, it shows a schematic perspective view of an exemplary fork 16 that may be included as a utensil 12 in module 10. Fork 16 has a top face 26 and a bottom face 28. Fork 16 also has two sides 30 and an end 32. Top face 26, bottom face 28, sides 30, and end 32 may each have any number of profiles, including, for example, flat, straight, shaped, curved, or tapered. In some exemplary embodiments, fork 16 is shaped such that a plurality of forks 16 may be stacked on top of one another. In such a stacked configuration, sides 30 of one fork 16 may align vertically with sides 30 from an adjacent utensil 12 (e.g., another fork 16).

Figure 2C:
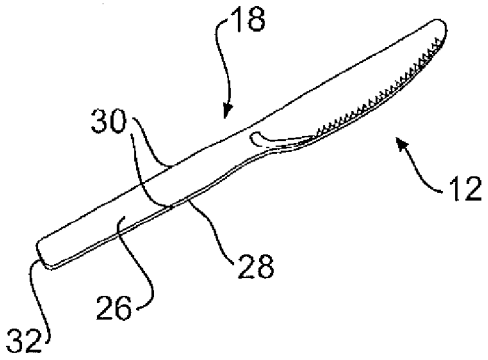
FIG. 2C is a schematic perspective view of an exemplary knife.

Referring to FIG. 2C, it shows a schematic perspective view of an exemplary knife 18 that may be included as a utensil 12 in module 10. Knife 18 has a top face 26 and a bottom face 28. Knife 18 also has two sides 30 and an end 32. Top face 26, bottom face 28, sides 30, and end 32 may each have any number of profiles, including, for example, flat, straight, shaped, curved, or tapered. In some exemplary embodiments, knife 18 is shaped such that a plurality of knives 18 may be stacked on top of one another. In such a stacked configuration, sides 30 of one knife 18 may align vertically with sides 30 from an adjacent utensil 12 (e.g., another knife 18).

Figure 2D:
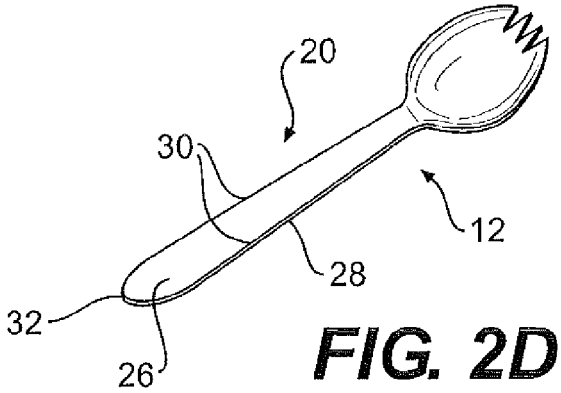
FIG. 2D is a schematic perspective view of an exemplary spark.

Referring to FIG. 2D, it shows a schematic perspective view of an exemplary spork 20 that may be included as a utensil 12 in module 10. Spork 20 has a top face 26 and a bottom face 28. Spork 20 also has two sides 30 and an end 32. Top face 26, bottom face 28, sides 30, and end 32 may each have any number of profiles, including, for example, flat, straight, shaped, curved, or tapered. In some exemplary embodiments, spork 20 is shaped such that a plurality of sporks 20 may be stacked on top of one another. In such a stacked configuration, sides 30 of one spork 20 may align vertically with sides 30 from an adjacent utensil 12 (e.g., another spork 20).

FIG. 3A shows a portion of a plurality of utensils 12 stacked in an exemplary manner such that sides 30 are generally aligned. Coupling strip 34 couples utensils 12 to one another to form module 10. In FIG. 3A, coupling strip 34 is shown as a continuous strip. However, coupling strip 34 also may be applied in a discontinuous or intermittent manner. FIG. 3A also shows coupling strip 34 substantially perpendicular to sides 30, such that coupling strip 34 would appear to align substantially vertically when the module 10 of utensils 12 is oriented in an upright position. However, coupling strip 34 may be applied at any other angles and/or other lengths that couple at least two utensils 12 to one another.

Exemplary coupling strip 34 may comprise an adhesive, a common portion of formable material, or a combination of both. If coupling strip 34 is an adhesive, it can include any combination of adhesives known in the art. For example, such types of adhesives may include, but are not limited to, hot melt adhesive, epoxy, glue, resin, and cement. According to some embodiments, adhesive may be applied in a configuration that secures utensils 12 of a module 10 to one another, but which allows a user and/or a dispenser to break the bond between adjacent utensils 12. For example, a thinner coupling strip 34 may be used with stronger adhesives while a relatively weaker adhesive may be applied in relatively thicker coupling strips 34.

According to some embodiments, coupling strip 34 may include a common portion of the formable material that forms utensils 12. For example, the common portion may be formed by softening or melting a portion of at least one side 28 of a utensil 12 and allowing the softened or melted portion to cool in a configuration such that it couples the utensil 12 with at least one adjacent utensil 12. The common portion may be formed, for example, by introducing an additional piece of formable material and softening or melting some or all of that piece such that upon cooling it couples at least two utensils 12 to one another. The common portion may further be formed by introducing an additional piece of formable material, softening or melting a portion of one or more utensils 12, and attaching the additional piece to the softened or melted portion or portions of the utensils 12, such that upon cooling at least two utensils 12 are coupled to one another. Softening or melting the formable material may be accomplished by any method known in the art, including but not limited to the application of heat, electricity, and/or friction. According to some embodiments, the common portion of formable material may be formed in an integral manner, together with utensils 12, for example, via a molding process such as form molding or injection molding, where the common portion and the utensils 12 of module 10 are formed during the same molding process.

In some embodiments, the coupling strip 34 may contact at least one of the top face 26, bottom face 28, and one of sides 30 of a utensil 12 to be coupled. When coupling strip 34 contacts at least one side 30, coupling strip 34 may also extend into the gaps 24 between each utensil 12, and may also come into contact with the top face 26 or bottom face 28 of one or more utensils.

FIG. 3B shows a plurality of exemplary utensils 12 stacked such that sides 30 are generally aligned. Coupling areas 36 couple at least two utensils 12 to one another. Coupling areas 36 may include adhesive deposits, common portions of formable material, or a combination of the two. If adhesive deposits are utilized, the adhesive may be any combination of adhesives known in the art, including, but not limited to, hot melt glue, epoxy, glue, resin, and cement. The adhesive deposits may be applied in any configuration that serves to couple at least two of the utensils 12. The adhesive deposits may be configured such that a user and/or a dispenser can break the adhesive bonds and separate a utensil 12 from module 10. The adhesive deposits may be located such that at least one deposit contacts the sides 30 of two adjacent utensils 12. The adhesive deposits may also be located between the utensils 12, such that the adhesive deposit contacts the top face 26 of one utensil and the bottom face 28 of another utensil 12. If the adhesive deposits are positioned between the utensils 12, the size, shape, and material make-up of the adhesive deposit may influence the size of the gaps 24 between adjacent utensils 12.

Coupling areas 36 may also include common portions of formable material shared by at least two adjacent utensils 12. In some embodiments, the common portion may be formed by softening or melting a portion of at least one side 30 of a utensil 12 and allowing the softened or melted portion to cool in a configuration such that it couples the utensil 12 with at least one adjacent utensil 12. According to some embodiments, the common portion may be formed by introducing additional pieces of formable material and softening or melting some, or all, of those pieces such that upon cooling at least two utensils 12 are coupled to one another. The common portion may further be formed by introducing one or more additional pieces of formable material, softening or melting a portion of one or more utensils 12, and attaching the additional piece to the softened or melted portion or portions of the utensils 12, such that upon cooling the at least two utensils 12 are coupled. The amount of formable material may be varied to control the gaps 24 between adjacent utensils 12. Softening or melting the formable material may be accomplished by any method known in the art, including but not limited to the application of heat, electricity, friction, or a combination thereof. The common portions of formable material may be configured such that a user and/or a dispenser can separate the utensils 12 from one another.

FIG. 3C shows a plurality of exemplary utensils 12 stacked such that sides 30 are generally aligned. According to some embodiments, the utensils 12 may have at least one protrusion 38 made from formable material. The protrusions 38 may be used to facilitate coupling adjacent utensils 12 to one another. The protrusions 38 may be provided in any number of shapes, or in a shape that at least partially spans the gaps 24 between utensils 12. For example, the protrusions 38 may be located on the sides 30, the top face 26, or the bottom face 28 of the utensils 12. The utensils 12 may be coupled by protrusion coupling areas 40. For example, protrusion coupling areas 40 may include adhesive and/or a common portion of formable material.

According to some embodiments, at least two utensils 12 may be coupled via adhesive deposits on the protrusions 38. The adhesive deposits may be any combination of adhesives known in the art, including, but not limited to, hot melt glue, epoxy, glue, resin, and cement. For example, the adhesive deposits may be applied to the protrusions 38 such that at least two utensils 12 are coupled to one another.

According to some embodiments, at least two utensils 12 may be coupled via a common portion of formable material that includes at least one protrusion 38. Coupling may be accomplished by softening or melting a portion of formable material of one or more of utensils 12 such that upon cooling, the utensils 12 become coupled to one another. For example, the side 30 of a utensil 12 may be softened or melted such that it joins with protrusion 38 upon cooling, or the protrusion 38 may be softened or melted such that it joins with a portion of a utensil 12 upon cooling. Of course, the protrusion 38 and the side 30 of a utensil 12 may both be softened or melted such that they join each other upon cooling. According to some embodiments, the common portion of formable material may be formed in an integral manner, together with utensils 12, for example, via a molding process such as form molding or injection molding, where the common portion and the utensils 12 of module 10 are formed during the same molding process. According to some embodiments, two protrusions 38 may be aligned such that the two protrusions 38 combine after softening or melting to form the common portion of formable material.

Softening or melting the formable material may be accomplished by any method known in the art, including but not limited to the application of heat, electricity, friction, or any combination thereof. In some embodiments, the common portions of formable material may be configured such that a user and/or a dispenser may separate the utensils 12 from one another. The protrusions 38 may be formed such that upon decoupling, the protrusion 38 completely detaches from previously-coupled utensils 12. Alternatively, the protrusion 38 may be formed such that upon decoupling, it remains attached to one of the previously-coupled utensils 12.

Protrusions 38 may be formed in various shapes and sizes. Exemplary shapes include, without limitation, at least one of a square, a rectangle, a triangle, a circle, a cylinder, a sphere, a cube, a box, a pyramid, a star, and the like. The chosen shape can provide a formable surface area configured such that after coupling—either by adhesive, by forming a common portion of formable material, or both—the bond may be broken by a user and/or a dispenser. According to some embodiments, protrusions 38 are shaped such that they also assist in aligning or maintaining the alignment of the stack of utensils 12 before application of an adhesive or formation of a common portion of formable material.

Figure 3D:
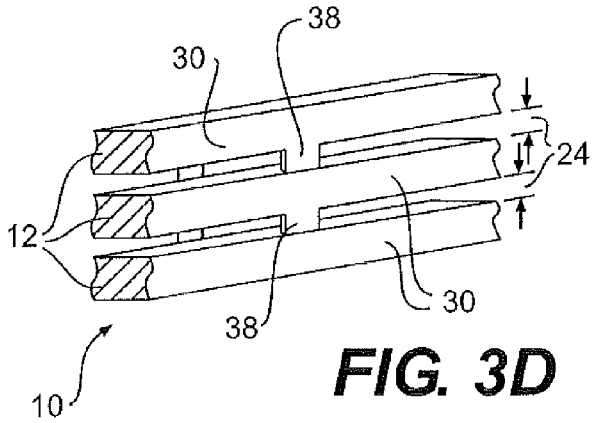
FIG. 3D is a schematic perspective view of exemplary utensils utilizing exemplary protrusions as a spacing feature.

FIG. 3D shows a plurality of exemplary utensils 12 stacked such that the sides 30 are generally aligned. In some embodiments, the protrusions 38 may perform a spacing function. For example, the protrusions 38 may be formed at any location on one or more utensils 12. The protrusions 38 may occupy some amount of space within the gaps 24 between utensils 12, and may influence the separation between utensils 12. In some embodiments, one or more utensils 12 may be coupled to one another along one or both sides 30 of the utensils 12. If the utensils 12 are only coupled along one side 30, then module 10 may have some degree of flexibility. If the protrusions 38 are provided along one side 30 of the utensils 12, and the utensils 12 are coupled along the same side 30, then flexibility of the module 10 may be increased. In some embodiments, the flexibility may be influenced by controlling the size of the gaps 24 between utensils 12. Likewise, the gaps 24 between utensils 12 may be influenced by the size, shape, and/or location of protrusions 38. The protrusions 38 may perform a spacing function regardless of whether they are used to couple the utensils 12 to one another.

Figure 3E:
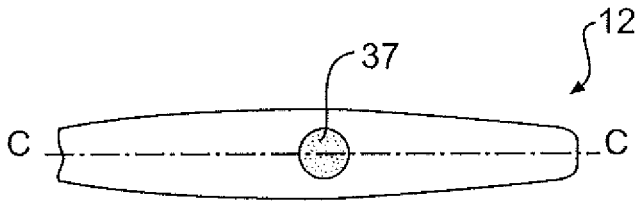
FIG. 3E is a schematic plan view of an exemplary utensil including an exemplary coupling bead.
Figure 3F:
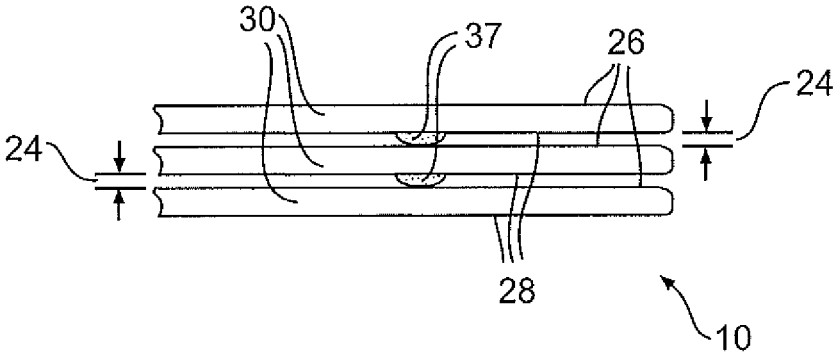
FIG. 3F is a schematic side view of exemplary utensils coupled by exemplary coupling beads.

FIG. 3E shows an exemplary utensil 12 including a coupling area 36 in the exemplary form of a coupling bead 37 disposed on utensil 12. In some embodiments, at least one coupling bead 37 may be used to couple a plurality of utensils 12 to form module 10, as shown in FIG. 3F. While FIGS. 3E and 3F show one coupling bead 37 per utensil 12, the embodiments should be understood to encompass any number of coupling beads 37 on each utensil 12. Coupling bead 37 may be configured with its center point on longitudinal axis C. Coupling bead 37 may include adhesive deposits, common portions of formable material, or a combination of the two. If adhesive deposits are utilized, the adhesive may be any combination of adhesives known in the art, including, but not limited to, hot melt glue, epoxy, glue, resin, and cement. The adhesive deposits may be applied in any configuration that serves to couple at least two of the utensils 12, for example, as shown in FIG. 3F. The adhesive deposits may be configured such that a user and/or a dispenser can break the adhesive bonds and separate a utensil 12 from module 10. The adhesive deposits may be located between the utensils 12, such that the adhesive deposits contact the top face 26 of one utensil and the bottom face 28 of another utensil 12. If the adhesive deposits are positioned between the utensils 12, the size, shape, and material make-up of the adhesive deposit may influence the size of the gaps 24 between adjacent utensils 12.

Coupling beads 37 may also include common portions of formable material shared by at least two adjacent utensils 12. In some embodiments, the common portion may be formed by softening or melting a portion of a utensil 12 and allowing the softened or melted portion to cool in a configuration such that it couples the utensil 12 with at least one adjacent utensil 12. According to some embodiments, the common portion may be formed by introducing additional pieces of formable material and softening or melting some, or all, of those pieces such that upon cooling at least two utensils 12 are coupled to one another. Alternatively, the common portion may be formed by softening or melting a portion of one or more utensils 12 and introducing one or more additional pieces of formable material, configured such that when the at least two utensils 12 cool, they may couple to one another. The amount of formable material may be varied to control the gaps 24 between adjacent utensils 12. Softening or melting the formable material may be accomplished by any method known in the art, including but not limited to the application of heat, electricity, friction, or a combination thereof. According to some embodiments, the common portion of formable material may be formed in an integral manner, together with utensils 12, for example, via a molding process such as form molding or injection molding, where the common portion and the utensils 12 of module 10 are formed during the same molding process. The common portions of formable material may be configured such that a user and/or a dispenser can separate the utensils 12 from one another.

Figure 4:
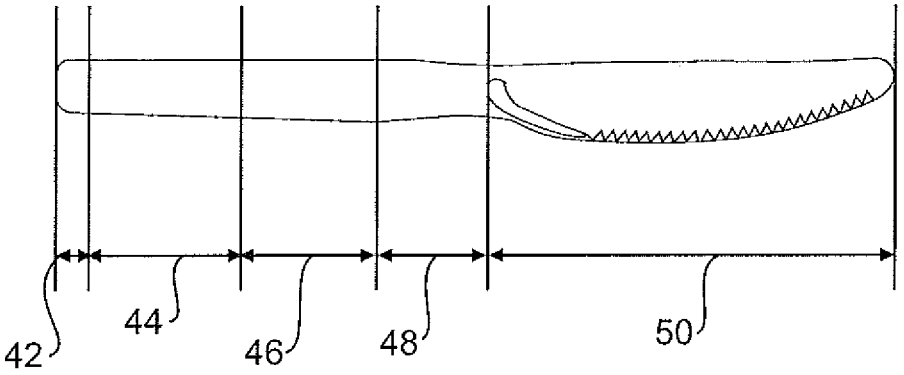
FIG. 4 is a schematic plan view of an exemplary utensil identifying different regions of the utensil.

FIG. 4 shows a schematic plan view of an exemplary utensil 12 divided into five regions: a handle end region 42, a first middle region 44, a second middle region 46, a third middle region 48, and a functional end region 50. According to some embodiments, at least two utensils 12 may be coupled at one or more locations within one or more of the five identified regions. According to some embodiments, the utensils 12 may be coupled along one side 30. According to some embodiments, the utensils 12 may be coupled along both sides 30. The coupling locations on each side 30 of the utensils 12 may mirror each other. For example, a utensil 12 may be coupled on both sides 30 at each of the first middle region 44, the second middle region 46, and the third middle region 48. The coupling locations need not mirror each other, however. For example, a utensil 12 may be coupled on one side 30 at first middle region 44 and third middle region 48, while on the other side 30 the utensil 12 may be coupled at the second middle region 46. Setting coupling locations at any additional combination of sides 30 and/or regions is within the scope of these embodiments.

Figure 5:
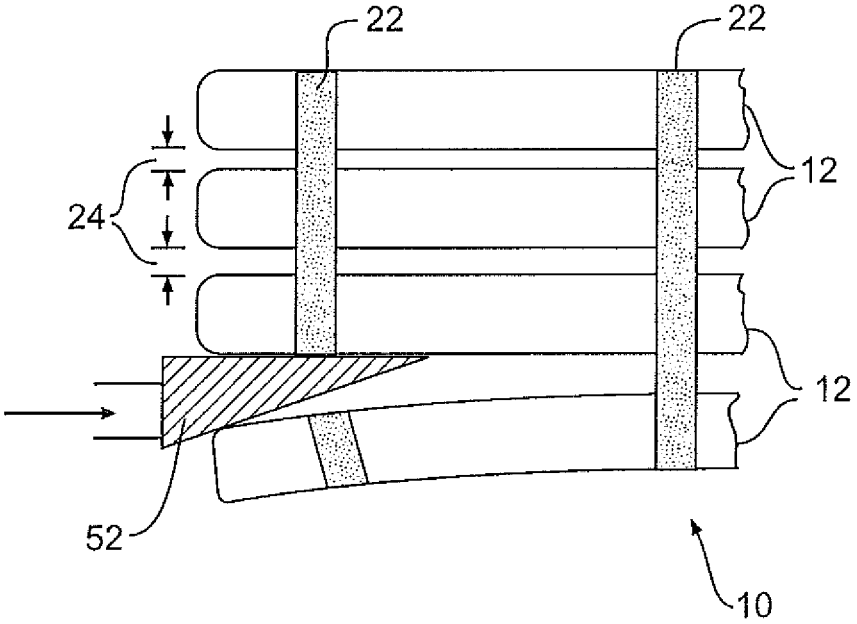
FIG. 5 is a schematic side view of an exemplary decoupler decoupling an exemplary utensil from an exemplary module of utensils.

FIG. 5 shows a schematic side view of a plurality of utensils 12 coupled by couplers 22, where one utensil 12 is being decoupled from module 10 via a decoupler 52. The couplers 22 are shown in a continuous strip configuration, although they may be utilized in other forms, such as those identified in connection with previously described embodiments. For example, the couplers 22 may be formed in discontinuous or intermittent sections. The discontinuous or intermittent sections may couple as few as two utensils 12 or as many as 10, 15, 20, or 100 or more utensils 12, as any number of utensils 12 is contemplated for a module 10. The couplers 22 are not limited to continuous or discontinuous/intermittent sections, however. For example, the couplers 22 may be formed via at least one of an adhesive and a common portion of the formable material, regardless of whether the continuous strip configuration or the discontinuous or intermittent configuration—or both—are used.

The exemplary decoupler 52 may be part of, for example, a conventional dispenser. In the exemplary embodiment shown, the decoupler 52 is a generally wedge-shaped tip configured to be inserted into a gap 24 between two utensils 12. According to some embodiments, however, decoupler 52 does not have a wedge-shaped tip. The size of the decoupler 52 may force the utensils 12 on either side of the decoupler 52 in opposite directions, breaking the bond or bonds (e.g., adhesive bonds and/or bonds formed via a common portion of formable material) between those utensils 12. According to some embodiments, the tip of the decoupler 52 may apply pressure to the couplers 22 directly, severing the coupler 22 material. According to some embodiments, the decoupler 52 may apply pressure to the couplers 22 directly and may also force the utensils 12 on either side of the decoupler 52 in opposite directions. In other embodiments, the decoupler 52 (e.g., a decoupler without a generally-wedge shaped tip) may apply a force to an individual utensil 12 such that the bond or bonds (e.g., adhesive bonds and/or bonds formed via a common portion of formable material) coupling that utensil 12 to at least one other utensil 12 is/are broken. The decoupler 52 may be operated by direct user input, by user input transformed by a system providing mechanical advantage, or by independent power source such as, for example, an electric motor and/or electric, pneumatic, or hydraulic actuator.

The decoupler 52 is not limited by size or shape. According to some embodiments, the decoupler 52 may include a thin, sharp edge, which is inserted into the gap 24 between utensils 12 and severs the couplers 22 (e.g., FIG. 5). According to some embodiments, the decoupler 52 may include a clamp-shaped head that partially surrounds one utensil 12 and applies a force that decouples at least one of the utensils 12 from module 10. In other embodiments, the decoupler 52 may include a round head. In further embodiments, the decoupler 52 may include a partially round head that utilizes a camming action to rotatably decouple one or more utensils 12 from module 10. The decoupler 52 is similarly not limited in quantity. For example, a decoupler 52 may include a plurality of portions (e.g., head, tip, etc.) that work together or independently to decouple one or more of utensils 12 from a module 10.

According to some embodiments, the decoupler 52 may be part of a dispenser for dispensing individual utensils 12. The dispenser may be configured to receive one or more modules 10 of utensils 12, and may utilize a decoupler 52 to decouple utensils 12 from a module 10, individually and/or in groups. The dispenser may also hold one or more types of utensils 12, including one of at least a spoon 14, a fork 16, a knife, 18, and/or a spork 20.

It will be apparent to those skilled in the art that various modifications and variations can be made to the structures and methodologies described herein. Thus, it should be understood that the invention is not limited to the subject matter discussed in the description. Rather, the present invention is intended to cover modifications and variations.

What is claimed is:

1. A module of cutlery, the module comprising:

more than two utensils comprising a formable material, each of the utensils comprising a handle with a top face, a bottom face, and pair of sides, wherein the more than two utensils are separably coupled to one another via a unitary coupler in the form of a common portion of the formable material formed along a length of the utensils by softening or melting and by allowing the softened or melted portion to cool so as to stack the top face of a utensil below the bottom face of an adjacent utensil in a substantially parallel configuration.

2. The module of claim 1, wherein the more than two utensils are stacked.

3. The module of claim 1, wherein the more than two utensils comprise at least one of a fork, a spoon, a knife, and a spork.

4. The module of claim 1, wherein the formable material comprises at least one material selected from the group comprising polystyrene, polyethylene, and polypropylene.

5. The module of claim 1, wherein the common portion is formed from at least one of hot melting, soldering, spot welding, and ultrasonic welding.

6. The module of claim 1, wherein at least one of each pair of utensils comprises at least one protrusion, wherein the at least one protrusion forms the common portion of the formable material.

7. The module of claim 6, wherein the at least one protrusion is configured to at least partially detach from at least one of each pair of utensils.

8. The module of claim 1, wherein the utensils are separably coupled to one another via a plurality of coupling locations.

9. The module of claim 1, further comprising a band configured to assist retaining the more than two utensils to one another to form the module.

10. A module of cutlery, the module comprising:

more than two utensils comprising a formable material, each of the utensils comprising a handle with a top face, a bottom face, and pair of sides, wherein the more than two utensils are separably coupled to one another via a bonding coupler in the form of a common portion of the formable material formed along a length of the utensil by softening or melting and by allowing the softened or melted portion to cool so as to stack the top face of a utensil below the bottom face of an adjacent utensil in a substantially parallel configuration.

* * * * *